United States Patent [19]

Pierlot

[11] 4,089,308

[45] May 16, 1978

[54] CARBURATION DEVICES

[75] Inventor: Michel Pierlot, Le Pecq, France

[73] Assignee: Societe Industrielle de Brevets et d'Etudes S.I.B.E., France

[21] Appl. No.: 730,740

[22] Filed: Oct. 8, 1976

[30] Foreign Application Priority Data

Oct. 31, 1975 France ..... 75 33315

[51] Int. Cl.[2] ..... F02M 9/08

[52] U.S. Cl. ..... 123/119 R; 123/119 E; 261/23 R; 261/50 A; 261/23 A

[58] Field of Search ..... 123/119 R, 119 E, 127; 261/50 A, 23 R, 23 A

[56] References Cited

U.S. PATENT DOCUMENTS

| | | | |
|---|---|---|---|
| 3,198,498 | 8/1965 | Mennesson | 261/50 A |
| 3,236,506 | 2/1966 | Mennesson | 261/50 A |
| 3,259,378 | 7/1966 | Mennesson | 261/50 A |
| 3,285,585 | 11/1966 | Mennesson | 261/50 A |
| 3,713,630 | 1/1973 | Laprade et al. | 261/50 A |

*Primary Examiner*—Wendell E. Burns
*Attorney, Agent, or Firm*—Stevens, Davis, Miller & Mosher

[57] ABSTRACT

A carburation device has auxiliary throttle means and a main throttle. The auxiliary throttle means opens automatically in proportion to the increase in the flow rate of air and actuates proportioning means metering the flow rate of fuel drawn into the intake pipe, downstream of the main throttle via a passage. The passage includes a chamber which is kept at a pressure substantially equal to the pressure in the portion of the intake pipe between the throttle means by a bypass passage connecting said portion and chamber, having means which are sensitive to at least one engine operating parameter and which, in operation, adjust a control cross-sectional area in the passage means between the chamber and the intake pipe.

5 Claims, 4 Drawing Figures

CARBURATION DEVICES

BACKGROUND AND SUMMARY OF THE INVENTION

The invention relates to carburation devices for internal combustion engines of the type comprising auxiliary throttle means in the intake pipe upstream of driver-actuated main throttle means, the auxiliary throttle means opening automatically and progressively in proportion to the increase in the flow rate of air through the pipe and actuating proportioning means metering the flow rate of fuel drawn into the intake pipe. There exists prior art carburation devices of this kind in which the fuel is sucked into the intake pipe via a duct opening into the pipe at a place where substantially the same degree of vacuum prevails as in the chamber bounded by the two throttle means in the intake pipe.

Usually, fuel is sucked into the intake pipe via a discharge orifice located between the two throttle means. In another device, described in French Patent Specification No. 1,329,682, means are provided which make it possible to deliver the fuel at other places along the intake pipe, more particularly downstream of the main throttle means. In that device, a pipe by-passes the main throttle means, one end of the pipe being connected to the intake pipe between the two throttle means and the other end opening downstream of the main throttle means via a reduced-section orifice, so that the vacuum in the bypass pipe is substantially equal to the pressure between the two throttle means. If the pipe delivering a metered amount of fuel opens near the reduced section, the fuel is introduced into the intake manifold donwstream of the main throttle means but is sucked by a vacuum which is however substantially equal to the vacuum in the intake pipe between the two throttle means.

In such a prior art device, the head loss undergone by the fuel at the pipe mouth must not be excessive as compared with the head loss produced by the fuel metering system (e.g. consisting of a needle having a varying cross-section and movable in a calibrated orifice). Furthermore, since the mouth of the by-pass pipe bringing air downstream of the throttle means must have a larger cross-section than the mouth of the duct supplying fuel, so that the fuel can travel freely through the mouth of the by-pass pipe, the flow cross-section provided by the last-mentioned mouth must be large and consequently an appreciable flow rate of air enters the intake manifold, particularly during idling. The idling conditions thus become hardly adjustable, particularly if such a device is used for each engine cylinder, thus multiplying the number of air inlets by the number of cylinders.

It is an object of the invention to provide an improved carburation device in which the aforementioned disadvantages are overcome, at least to a substantial extent.

According to the invention, there is provided a carburation device of the aforementioned type, wherein the fuel is drawn into the intake pipe downstream of the main throttle means via passage means including a chamber which is kept at a pressure substantially equal to the pressure in the portion of the intake pipe between the two throttle means by a by-pass passage connecting said portion and chamber, having means which are sensitive to at least one engine operating parameter and which, in operation, adjust a control cross-sectional area in the passage means between the chamber and the intake pipe.

The device according to the invention may be regarded as comprising means for modulating the flow control cross-sectional area in accordance with the engine fuel requirements, i.e. for reducing the cross-section at low engine load or speed and increasing it at high engine load or speed. The control cross-sectional area will be the smallest cross-section of the part of the passage means between the chamber and the intake pipe, and is usually placed at the mouth of the passage means into the intake pipe.

The invention will be more clearly understood from the following description of carburation devices given by way of non-limitative examples.

SHORT DESCRIPTION OF THE DRAWINGS

DETAILED DESCRIPTION OF PREFERRED EMBODIMENTS

Figure 1:
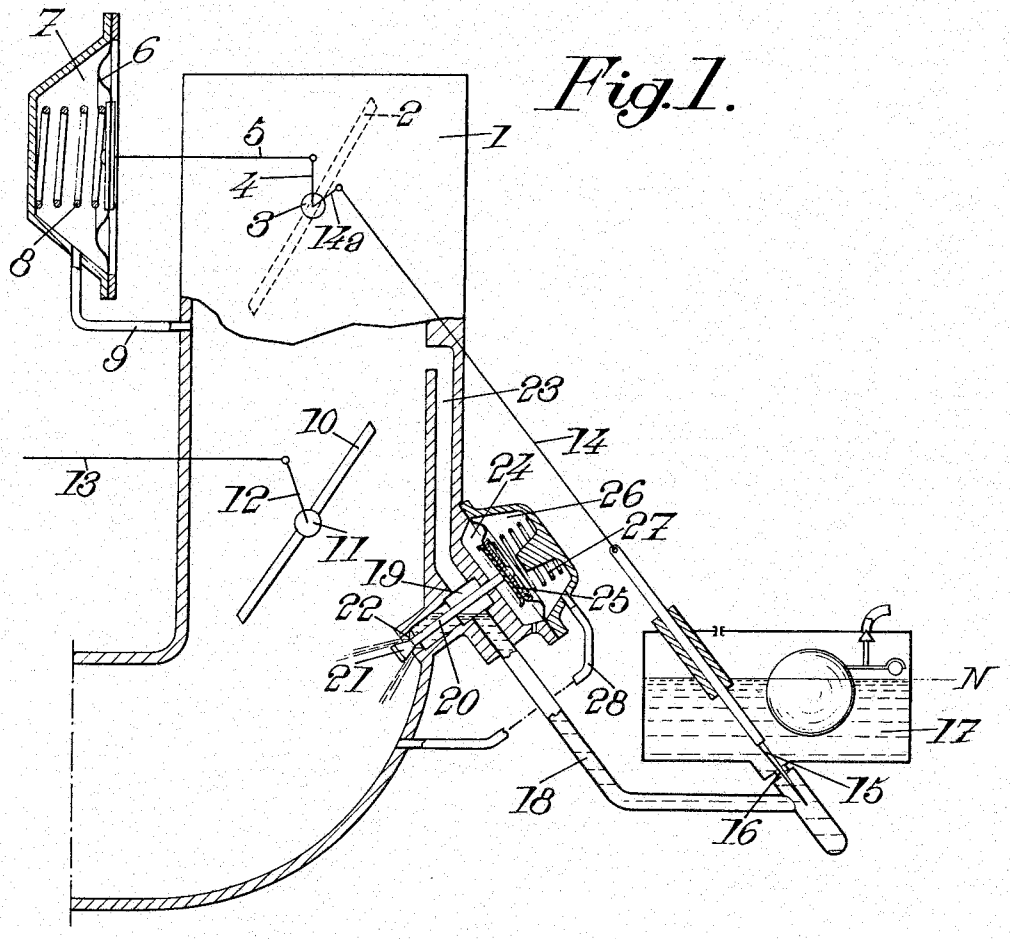
FIG. 1 is a diagrammatic representation of the main components of the carburation device, in section along a vertical plane, the components being shown in the positions which they occupy during operation under load.

Referring to FIG. 1, there is shown a device which comprises an intake pipe 1 containing auxiliary throttle means 2 consisting of a balanced butterfly valve mounted on a rotating shaft 3, and main throttle means 10 located downstream of the valve 2. Shaft 3 is connected by a lever 4 and a rod 5 to a diaphragm 6 forming the movable wall of a compartment 7 connected to the intake pipe 1 by a passage 9 opening into the portion of the intake pipe 1 between the auxiliary throttle means 2 and the main throttle means 20. A spring 8 compressed between the bottom wall of compartment 7 and diaphragm 6 exerts a force tending to close the auxiliary throttle means 2.

The main throttle means comprises a butterfly 10 mounted on a shaft 11 and actuated by a lever 12 and rod 13 which in turn is controlled by the driver or by a component (such as a speed regulator or servo-control) replacing the driver.

In such a device, the angle of aperture of the auxiliary throttle means 2 corresponds to the flow rate of air in the intake pipe 1; a degree of vacuum which increases with the flow rate prevails in the portion of the intake pipe 1 between means 2 and 10.

The auxiliary throttle means 2 can, of course, have a structure different from that shown in FIG. 1, e.g. it can be an eccentric butterfly valve which may or may not be associated with a pneumatic capsule and which the stream of air through pipe 1 tends to open against the action of a return spring, which tends to close it. Alternatively, means 2 can be a valve member which can move transversely with respect to pipe 1. Such devices are well-known and need not be described here.

The auxiliary throttle means 2 is operatively connected to fuel metering means which controls the flow rate of fuel delivered to the engine. In the embodiment illustrated in FIG. 1, shaft 3, acting via a lever 14*a* and a rod 14, drives a variable cross-section needle 15 which moves axially in a stationary calibrated orifice 16 so that each position of needle 15 corresponds to a given fuel flow cross-sectional area.

Instead of a needle, the metering means can comprise another device, e.g. a rotating or sliding valve member, which provides an adjustable flow cross-section for the fuel.

The fuel is drawn from a float chamber 17 where fuel is at constant level N. In the top part of chamber 17, the pressure is approximately equal to the pressure in the air inlet of pipe 1 upstream of all the throttle means. After having been proportioned by the metering means comprising needle 15 and orifice 16, the fuel flows through a duct 18 to a chamber 19 communicating with the intake pipe downstream of the throttle means 10. The mouth 29 of duct 18 (FIG. 2) comprises an annular flow cross-section bounded by the wall of an orifice 22 and a funnel-shaped, approximately frusto-conical end spigot 21 of a rod 20, which is movable along the axis of orifice 22. Rod 20 is in turn secured to a movable diaphragm 25 forming the movable wall of a chamber 26 containing a spring 27 and connected by a pipe 28 to the intake pipe downstream of the main throttle means 10. The other surface of the diaphragm is subjected to the atmospheric pressure which prevails in a space 24.

Chamber 19 is connected by a bypass pipe 23 to the portion of the intake pipe between the two throttle means 2, 10.

The device operates as follows.

Figure 2:
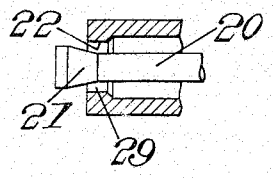
FIGS. 2 and 3 are views on an enlarged scale showing the mouth of the passage means of the device in FIG. 1, during operation under load and during idling, respectively.

When the air flow rate through the intake pipe is large, throttle means 2 and 10 are approximately in the positions shown in FIG. 1. The degree of vacuum transmitted by pipe 28 is small. The spring 27 expands and moves rod 20 in the opening direction of mouth 29 (i.e. towards the left in FIGS. 1 and 2) until the mouth is almost completely open. The flow section then has its maximum value (FIG. 2).

The vacuum in chamber 19 is then that transmitted by the bypass pipe 23 of relatively large cross-section, as modified by the existing vacuum in the intake pipe, which is transmitted into chamber 19 via mouth 29. However, since the air flow rates are relatively large and the throttle means 2, 10 are wide open, the pressure drops produced by means 2, 10 are relatively small and the vacuum in the intake pipe downstream of means 10 is not considerable, whereas the differences between the cross-sections of passages 29 and 23 remain very appreciable. Consequently, the vacuum in chamber 19 is nearly the same as the pressure in pipe 23, i.e. in the part of the intake pipe between the throttle means 2, 10.

Consequently, the proportioned fuel flows under a pressure equal to the difference between level N of the float chamber 17 and the vacuum in chamber 19 equal to the vacuum in the aforementioned portion of duct 1. The quantity of air travelling through the auxiliary throttle means 2 is subjected to the difference between the pressure in the air inlet of pipe 1 and the pressure downstream of throttle means 2, i.e. the same pressure as at 23.

Consequently, the air and fuel flow under the same pressure difference. If the air and fuel cross-sections are made proportional by giving a suitable cross-section to needle 15, the richness of the mixture remains constant.

If, on the other hand, the engine load and/or speed are small, throttle means 2, 10 are almost closed. In that case, the degree of vacuum downstream of throttle means 10 is very high. If the cross-section of mouth 29 remained unchanged, pipe 23 would need to have a considerable cross-section to prevent the resulting high degree of vacuum from affecting the vacuum in chamber 19.

Figure 3:
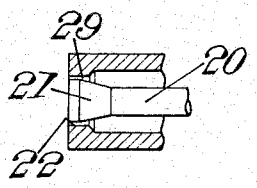

The device as described overcomes the difficulties which would result in a continuous air flow greatly in excess of what is acceptable. The vacuum transmitted by pipe 28 acts on the movable diaphragm 25 and moves it (towards the right in FIG. 1) against the action of spring 27, until the largest diameter part of spigot 21 is in the annular passage 22, as shown in FIG. 3.

Then, the annular cross-section of mouth 29 is considerably reduced; consequently, in spite of the increased degree of vacuum in the intake pipe downstream of means 10, the respective cross-sections of mouth 29 and pipe 23 are such that the vacuum in chamber 19 remains substantially the same as the pressure in pipe 23, i.e. in the portion of the intake pipe between throttle means 2 and 10.

Consequently, operation is the same as previously explained, since the richness of the mixture is practically unaffected by the degree of vacuum in the intake pipe downstream of 10.

It can be seen that, particularly during idling, this construction gives mouth 29 a very small annular flow cross-section, which has the advantage of driving air and fuel at high speed through the annular cross-section, thus improving the atomisation of fuel and, in addition, preventing an excessive amount of air from being admitted during idling thereby making it impossible to obtain suitable idling of the engine.

Figure 4:
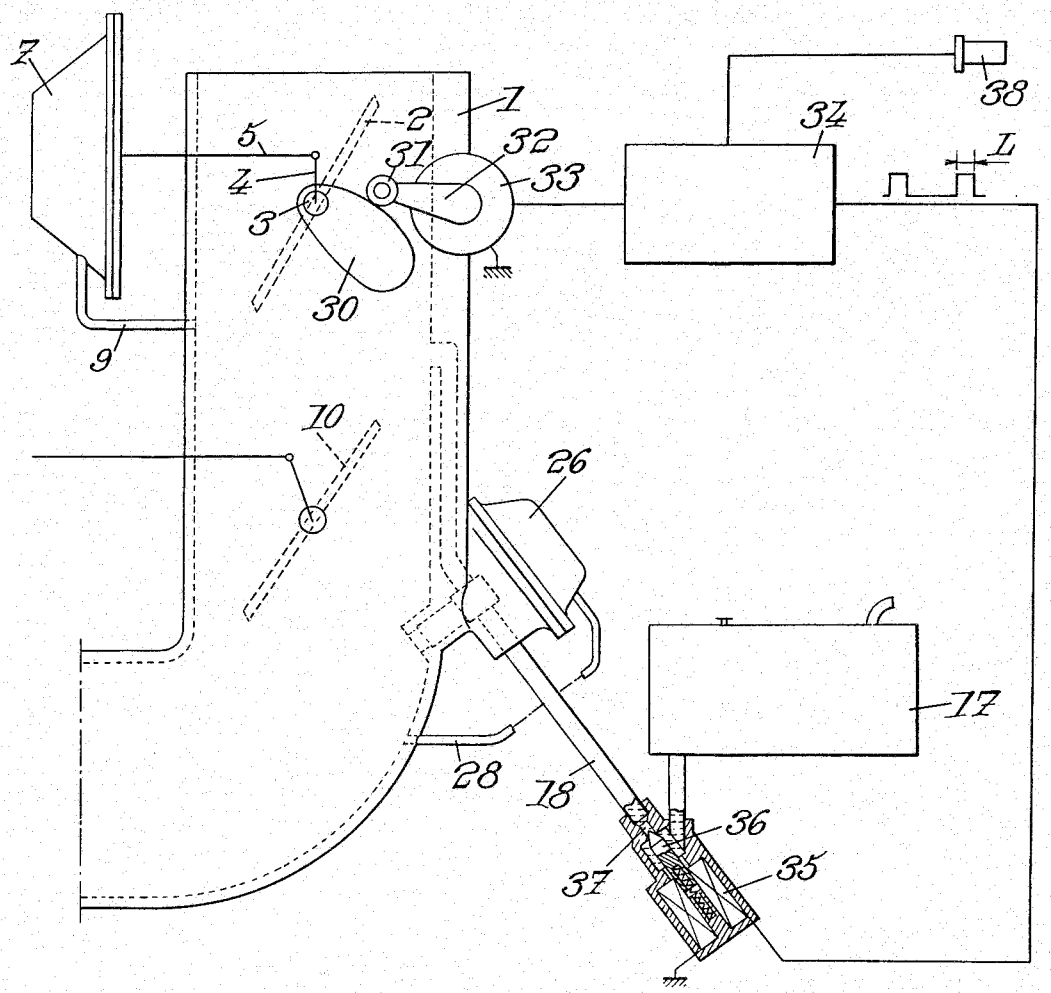
FIG. 4, similar to FIG. 1, shows a modified embodiment.

In the modified embodiment illustrated in FIG. 4 (where the components already shown in FIG. 1 are denoted by the same reference numbers), the mechanical metering means in FIG. 1 is replaced by an electromagnetic metering system which can be of the kind described in French Patent specification 2,032,021.

Referring to FIG. 4, the metering system comprises a cam 30 actuated by shaft 3 of throttling means 2 and cooperating with a roller 31 mounted on a lever 32. When the lever rotates, it varies the resistance of a potentiometer 33. Potentiometer 33 is connected to a control input of an electronic circuit 34 comprising e.g. an oscillator sending signals at a given frequency but having a variable duration L to an electromagnet 35 acting on a valve needle 36 controlling a calibrated orifice 37 connecting the float chamber 17 to duct 18. Each signal conveys an electrical pulse of duration L to electromagnet 35 and thus opens valve 36 so that fuel can flow through orifice 37. The total time during which the orifice is open during a predetermined time period will thus depend on the number of signals during that time period and their length L.

In any case, the quantity of fuel delivered during a predetermined period depends on the position of the slider of potentiometer 33, which varies length L at a rate determined by cam 30. Cam 30 has an outline such that the quantity of fuel can be metered in proportion to the quantity of air admitted, so that the richness of the mixture is suitable under all engine operating conditions. The same system as before is used for varying the flow cross-section of mouth 29 in dependence on the engine load.

The device in FIG. 4 has the advantage of not comprising a mechanical transmission between component 2 and the metering system, so that the latter can be placed at any required spot, at a considerable distance from member 2 if required. There may be one metering valve per engine cylinders. Another advantage is that the metering system can be designed so that needle 36 rests on its seat when not energised by electromagnet 35, thus preventing leaks of fuel when the engine is switched off. This advantage is particularly important in the case of engines operating at a high temperature, in which vapour locks and ejection of fuel by vapour are prone to occur in ducts such as 18. It is simply necessary to place the metering system close to the fuel outlet, in which case any fuel bubble will have the effect simply of driving back fuel towards the float chamber 17 (which is not a disadvantage) instead of forcing the fuel into the intake pipe, as in conventional carburation systems.

Finally, the amount of fuel sent to the engine can be very easily adjusted when an electronic system such as 34 is used, since that system delivers square waves having a variable length L and a preset frequency. If potentiometer 33 determines the length L of the square waves, one or more pick-ups can be provided so as to alter either the frequency or the time length of the square waves. The total time during which the calibrated orifice 37 is open during a predetermined time period will then be modified and will change the fuel flow rate for a given position of butterfly valve 2, in dependence on a certain number of operating parameters. For example, there may be provided a pick-up 38 sensitive to the ambient air pressure or temperature and which modifies the amount of fuel actually sent into the engine, thus maintaining the mixture at normal richness. The pick-up can be of any known kind; it can be sensitive to air temperature or pressure, to the water or oil pressure of the engine, to the composition of the exhaust gases, and more generally to any engine operating condition or operating parameter.

I claim:

1. A carburation device for an internal combustion engine comprising auxiliary throttle means in the intake pipe upstream of driver-actuated main throttle means, the auxiliary means opening automatically and progressively in proportion to the increase in the flow rate of air through the intake pipe and proportioning means controlled by the auxiliary throttle means and metering the flow rate of fuel drawn into the intake pipe downstream of the main throttle means via passage means including a chamber which is kept at a pressure substantially equal to the pressure in the portion of the intake pipe between the two throttle means by a bypass passage connecting said portion and chamber, having control means which are sensitive to at least one engine operating parameter and, in operation, adjust a control cross-sectional area in the part of the passage means between the chamber and the intake pipe.

2. A carburation device according to claim 1, wherein said control means are constructed to vary the control cross-sectional area according to the engine fuel requirements, i.e. reduce the section at low engine load or speed and increase it at high engine load or speed.

3. A carburation device according to claim 1, wherein the control cross-sectional area constitutes the opening of the passage means into the intake pipe.

4. A device according to claim 1, wherein the control cross-sectional area is limited by a movable needle of variable cross-section connected to an actuating diaphragm one surface of which bounds a space connected to the intake pipe downstream of the main throttle means.

5. A device according to claim 1, wherein the metering device is electromagnetically actuated and disposed in the immediate neighbourhood of the control means.

* * * * *